United States Patent [19]

Pelletier et al.

[11] 4,434,413

[45] Feb. 28, 1984

[54] ELECTRICAL CIRCUIT BREAKER MODULE

[75] Inventors: Jean-Marc Pelletier, St-Louis de Terrebonne; Yvon Dion, McMasterville, both of Canada

[73] Assignee: Hydro-Quebec, Montreal, Canada

[21] Appl. No.: 313,214

[22] Filed: Oct. 20, 1981

[51] Int. Cl.[3] ..... H01H 71/16

[52] U.S. Cl. ..... 337/71; 337/105

[58] Field of Search ..... 337/102, 103, 105, 107, 337/71, 72, 75, 13, 3

[56] References Cited

U.S. PATENT DOCUMENTS 3,566,327 2/1971 Gryctko ..... 337/75 X 4,047,140 9/1977 Anderson et al. ..... 337/75

*Primary Examiner*—George Harris

*Attorney, Agent, or Firm*—Alan Swabey; Robert Mitchell; Guy Houle

[57] ABSTRACT

An improvement in an electrical circuit-breaker module of the narrow modular type connectible in stacked relationship with a plurality of modules in an electrical distribution panel. Each of the modules is associated with respective electrical distribution branch circuit and is provided with circuit interruption means for interrupting its associated electrical distribution branch circuit upon the occurrence of predetermined fault and overload currents on the branch circuit. The improvement comprises a controlled switch means mounted in at least one of the modules, without altering the thickness of the module in the vertical plane. The controlled switch means is connected in series with the circuit interruption means and is operable by command means exteriorly or interiorly of the module to assume an open or closed contact condition.

11 Claims, 5 Drawing Figures

ELECTRICAL CIRCUIT BREAKER MODULE

BACKGROUND OF THE INVENTION (a) Field of the Invention

The present invention relates to an improvement in known types electrical circuit-breaker module incorporating a conventional circuit-breaker and wherein a further controllable switch is provided to permit the connection and disconnection of the electrical circuit associated with the circuit-breaker module. The further controllable switch is housed in the module without alteration in the thickness (the height of its front wall) of the module in the vertical plane and the depth thereof.

There exists a need to provide an electrical circuit-breaker module, of the conventional type, which is insertable in stacked relationship with a plurality of such modules in an electrical distribution panel, and wherein the module comprises a further controllable switch to connect or disconnect the electrical distribution branch circuit associated with the module. The actuation of the controllable switch may be controlled from a location remote from the distribution panel whereby the controllable switch can be actuated when the need arises or automatically by programmable means. The fulfilment of such means would result in the control of each or selected electrical distribution branch circuits of a distribution panel whereby to control the supply to the loads of individual branch circuits. The advantages of being able to control the supply on each or some of the distribution branch circuits are numerous and particularly to control the total demand on an electrical feeder cable when re-establishing power after a major line fault to minimize the current demand on a cold cable after a line fault (cold load pick-up).

Another important advantage that such a circuit-breaker module would provide is to permit the consumer automatic control of various ones of his electrical distribution branch circuits by means of a timer device or other programmable device, whereby lamps or other types of electrical appliances can be controlled at certain predetermined times during a day while the premises are vacant, such as during vacation periods. Such activation of electrical appliances would simulate an occupied premise.

Another advantage of this type of electrical circuit-breaker module would be its ability to achieve load management thereby resulting in a conservation of energy, particularly with respect to electrical heating systems which may be programmed to be activated at predetermined times and/or in response to changes in weather conditions.

Another requirement is to provide a controllable switch element which is small enough to be incorporated in a circuit-breaker module and which requires a relatively small power supply for its operation to switch "on" and "off" electrical distribution branch circuits of 110 or 220 volts on other similar low voltage distribution circuits below 600 volts.

(b) Brief Description of Prior Art

Reference is made to U.S. Pat. No. 4,164,719 which discloses a load management apparatus which is operated independently of control by the customer whereby designated ones of electrical distribution branch circuits may be switched "on" and "off". The device of this patent is utilized to interrupt selected ones of the branch circuits and particularly non-critical branch circuits. A disadvantage of this proposal is that a second switch module is necessary for housing a further remotely operated switch, herein a relay. This provision makes it necessary to rearrange a complete distribution panel should one or two of the branch circuits be adapted with this further module. Additionally, the construction of a further module adds to the cost of fabrication and particularly installation of the module and relocation of other module resulting in a near complete rewiring job. Still further, when using relays to trip a 25 amps. circuits, a large coil is required and thus a larger power supply to operate its contacts.

SUMMARY OF THE INVENTION

It is a feature of the present invention to provide an improved electrical circuit-breaker module which meets the above described needs and substantially overcomes all of the disadvantages of the above-referred to prior art.

It is a further feature of the present invention to provide an electrical circuit-breaker module incorporating the conventional circuit-breaker and a controllable switch in the same module without altering the thickness of the module in the vertical plane.

Another feature of the present invention is to provide an improved electrical circuit-breaker module having a controllable switch element which is controlled at a location remote from a distribution panel and/or automatically by the consumer or a programmer device.

Another feature of the present invention is to provide an improved electrical circuit-breaker module having a conventional circuit-breaker and a controllable switch element and which is adaptable in an existing distribution panel incorporating a plurality of conventional electrical circuit-breaker modules without requiring the displacement of existing wire modules.

Another feature of the present invention is to provide an improved electrical circuit-breaker module having a conventional circuit-breaker and a controllable switch element and which is substantially economical to produce and install.

According to the above features, from a broad aspect, the present invention provides an improvement in an electrical circuit-breaker module of the narrow modular type connectible in stacked relationship with a plurality of modules in an electrical distribution panel. Each of the modules is associated with respective electrical distribution branch circuits and is provided with circuit interruption means for interrupting its associated electrical distribution branch circuit upon the occurrence of predetermined overload and fault currents on the branch circuit. The improvement comprises a controlled switch means mounted in at least one of the modules, without altering the thickness of the module in a vertical plane and the depth thereof. The controlled switch means is connected in series with the circuit interruption means and is operable by command means exteriorly or interiorly of the module to assume an open or closed contact condition.

DESCRIPTION OF THE DRAWINGS

A preferred embodiment of the present invention will now be described with reference to the examples thereof illustrated in the accompanying drawings in which.

Figure 1:
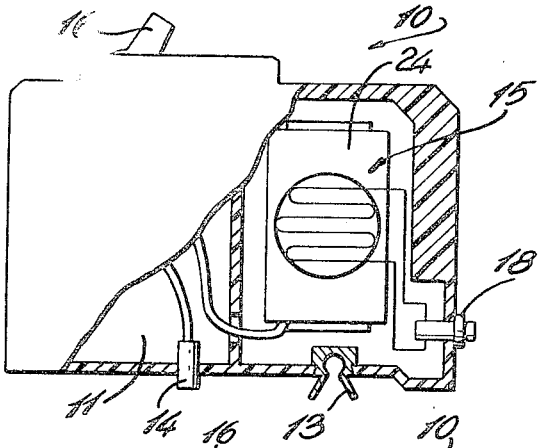
FIG. 1 is a fragmented simplified side view showing the improved electrical circuit-breaker module of the present invention.
Figure 2:
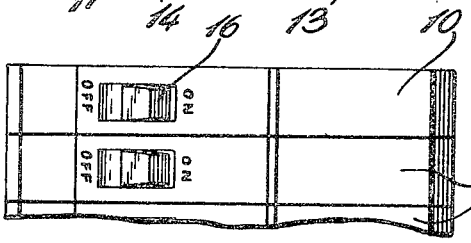
FIG. 2 is a front view showing the improved circuit-breaker module connected in stacked relationship in a distribution panel.
Figure 3:
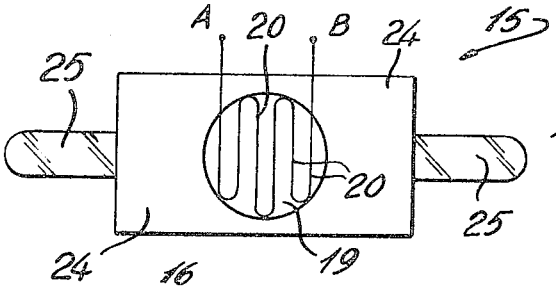
FIG. 3 is a plan view showing a controllable switch element of the thermo-mechanical type.

Referring now to the drawings and more particularly to FIGS. 1 to 3, there is shown generally at 10 the electrical circuit-breaker module of the present invention. The module is a conventional housing formed of an insulating material and houses a mechanical switch 16 combined with an overcurrent protection element 12 (see FIG. 4).

As shown additionally in FIG. 2 the circuit-breaker modules 10 are usually secured in stacked relationship with each other in a distribution panel. Each module may be provided with locating connector(s) 13 and electrical connector(s) 14 whereby a module is associated with a respective one of the plurality of electrical distribution branch circuits feeding in and out of the distribution panel, as is well known in the art.

The modules may also be of the type accommodating screw-type or tubular cartridge fuse elements which are movably securable in the front face thereof. These modules are constructed differently than those shown in FIGS. 1 and 2 but are also stacked one on top of the other and/or side-by-side.

Figure 4:
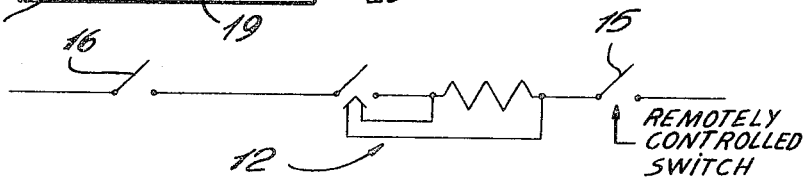
FIG. 4 is a simplified schematic diagram showing the connection of the controllable switch element in the circuit-breaker module.

The present invention relates to an improvement in such circuit-breaker module wherein a controllable switch element 15 is housed in the same module 10 without altering the thickness of the module in the vertical plane. As shown in FIG. 4 this switch element 15 is connected in series with the circuit-breaker element 12. As shown in FIG. 2 the circuit-breaker module is provided with a manual operating member 16 whereby the circuit-breaker may be placed to an "on" or "off" position.

In the case of the controllable switch element 15, it is operated remotely of the distribution panel and may be activated by an electrical signal, herein a small power source connected to the jack 18 whereby to activate or deactivate the switch element 15. The control could be made by the consumer and/or the electrical company who is the proprietor of the main electrical feeder cables. It is also conceived that the switch element 15 may be programmably controlled whereby the associated electrical circuit of the circuit-breaker module 10 may be switched "on" and "off" at predetermined times or conditions during a day to control various electrical appliances connected to the branch circuit.

Figure 5:
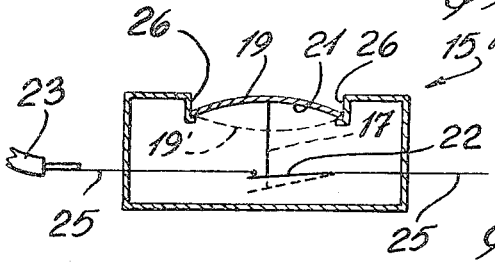
FIG. 5 is a cross-section view showing the basic construction of the thermo-mechanical switch element of FIG. 3.

Referring now additionally to FIGS. 3 and 5, there will be described the construction operation of the switch element 15 herein shown. However, it is pointed out that the switch element 15 may be constituted by an electronic switch or other means. The requirement is that the switch be relatively small and capable of being operated with very low power and further capable of switching "on" and "off" branch circuits of, for example 110 or 220 volts, as is commonly found in residential and commercial consumer load distribution panels.

The switch element 15 is herein constituted by a thermo-mechanical switch which comprises a contact actuation element which is a temperature-sensitive profiled bi-metallic wafer 19 onto which a heating wire element 20 is attached to cause heating and resulting deformation of the wafer. As better illustrated in FIG. 5 the wafer is of a concave/convex construction and formed of a bi-metallic material whereby heating said wafer causes it to expand and displace from its normal position to a further position as shown at 19' in FIG. 5.

The wafer 19 is retained in a rigid side wall 26 permitting the deflection of the wafer to a position as shown at 19'. A rigid rod 17 connects the lower surface 21 of the wafer 19 to a switch arm 22 whereby when the wafer is heated and assumes its position as shown at 19', the switch contact 22 is opened (as shown in phantom lines) thereby opening the associated electrical branch circuit 23 associated with the circuit-breaker module housing the switch element 15.

As shown in FIG. 3 the wafer 19 is of a circular configuration and the heating wire element 20 consists of a serpentine arrangement of the wire over a large surface of the wafer 19. Also, the wafer 19 may be formed from a rectangular bi-metallic strip. A power source is applied across the terminals A and B of the heating wire element whereby to activate the switch. The switch housing 24 is connected in series with the branch circuit line 23 by end connectors 25.

An advantage of this wafer type thermo-mechanical switch is that a very low power is required in order to actuate same. Also, the wafer construction will give a snap action whereby to quickly interrupt the electrical circuit 23 which may have for example a 30 amps. load. Thus, this type of switch construction makes it possible to incorporate same within the module housing the conventional circuit-breaker and realizing the various advantages described herein.

It is within the ambit of the present invention to cover any obvious modifications of the preferred embodiment described herein provided such modifications fall within the scope of the appended claims.

We claim:

1. In combination with an electrical circuit-breaker module of the narrow modular type connectible in stacked relationship with a plurality of said modules in an electrical distribution panel, each said module being associated with a respective electrical distribution branch circuit and wherein circuit interruption means is provided in each module for interrupting its associated electrical distribution branch circuit upon the occurrence of predetermined overload and fault currents on said branch circuit, the improvement comprising a controlled switch means mounted in at least one of said modules without altering the thickness of said module in a vertical plane and the depth thereof, said controlled switch means being connected in series with said circuit interruption means and being operable by command means exteriorly of said module to assume an open or closed contact condition.

2. A circuit-breaker module as claimed in claim 1 wherein said controlled switch means is operable by an electrical signal which is controllable at a location remote of said distribution panel.

3. A circuit-breaker module as claimed in claim 1 wherein said controlled switch means is operable by an electrical signal which is controllable at a location internally of said module.

4. A circuit-breaker module as claimed in claim 1 wherein said controlled switch means is an electronic switch.

5. A circuit-breaker module as claimed in claim 2 wherein said controlled switch means is a thermo-mechanical switch comprising a switch contact and a contact actuating element, said actuating element being a temperature-sensitive profiled bi-metallic element, means for heating said bi-metallic element, means connecting a surface of said bi-metallic element to said switch contact whereby a deformation of said surface caused by a predetermined change in temperature in said bi-metallic element material will cause an actuation of said switch contact.

6. A circuit-breaker module as claimed in claim 5 wherein said wafer is a circular wafer having opposed concave/convex surfaces.

7. A circuit-breaker module as claimed in claim 5 wherein said bi-metallic element is a bi-metal strip having opposed concave/convex surfaces.

8. A circuit-breaker module as claimed in claim 6 or 7 wherein said means connecting a surface of said bi-metallic element to said switch contact is a rigid rod secured at one end to a surface of said bi-metallic element and at an opposed end to said switch contact.

9. A circuit-breaker module as claimed in claim 5 wherein said means from heating said bi-metallic element is a heating wire element in contact with a surface of said bi-metallic element, and a controllable electrical source for feeding a current through said heating wire element to heat said bi-metallic element.

10. A circuit-breaker module as claimed in claim 9 wherein said controllable electrical source is remotely located from said module.

11. A circuit-breaker module as claimed in claim 1 wherein said circuit interruption means is a screw type or cartridge type fuse element.

* * * * *